US009869004B2

(12) United States Patent
Perkins

(10) Patent No.: US 9,869,004 B2
(45) Date of Patent: Jan. 16, 2018

(54) ARTICLE PROCESSING FIXTURE

(71) Applicant: American Manufacturing & Engineering Company, Inc., Cleveland, OH (US)

(72) Inventor: Michael W. Perkins, Cleveland, OH (US)

(73) Assignee: AMERICAN MANUFACTURING & ENGINEERING COMPANY, INC., Cleveland, OH (US)

( * ) Notice: Subject to any disclaimer, the term of this patent is extended or adjusted under 35 U.S.C. 154(b) by 101 days.

(21) Appl. No.: 14/518,725

(22) Filed: Oct. 20, 2014

(65) Prior Publication Data

US 2015/0108703 A1 Apr. 23, 2015

Related U.S. Application Data

(60) Provisional application No. 61/892,871, filed on Oct. 18, 2013.

(51) Int. Cl.

| | |
|---|---|
| ***B23Q 3/00*** | (2006.01) |
| ***C21D 9/00*** | (2006.01) |
| ***C23G 3/00*** | (2006.01) |
| ***B65D 6/08*** | (2006.01) |

(52) U.S. Cl.

CPC ..... *C21D 9/0025* (2013.01); *B65D 7/14* (2013.01); *C21D 9/00* (2013.01); *C23G 3/00* (2013.01)

(58) Field of Classification Search

USPC ..... 269/296

See application file for complete search history.

(56) References Cited

U.S. PATENT DOCUMENTS

| | | | | |
|---|---|---|---|---|
| 2,152,138 | A * | 3/1939 | Fletcher | C21D 9/0025 266/263 |
| 2,230,889 | A * | 2/1941 | McArthur | F16B 12/42 403/169 |
| 2,338,784 | A * | 1/1944 | Ruckstahl | C21D 9/0025 248/475.1 |
| 2,420,428 | A * | 5/1947 | Hill | C21D 9/0025 220/660 |
| 2,453,511 | A | 11/1948 | Jackson et al. | |
| 2,765,159 | A | 10/1956 | Garofalo et al. | |
| 2,962,273 | A * | 11/1960 | Moore | B65D 7/14 220/493 |
| 3,014,594 | A * | 12/1961 | Kerstner | B65D 25/107 211/41.17 |

(Continued)

*Primary Examiner* — Larry E Waggle, Jr.
*Assistant Examiner* — Alvin Grant
(74) *Attorney, Agent, or Firm* — Pearne & Gordon LLP

(57) ABSTRACT

A fixture for supporting articles in an industrial process comprises a plurality of first elongate members extending longitudinally in a first direction. The plurality of first elongate members each comprise a rod member having a riveted portion at an end thereof. The fixture further comprises a plurality of second elongate members extending longitudinally in a second direction that is substantially perpendicular to the first direction and a plurality of third elongate members extending longitudinally in a third direction that is substantially perpendicular to the first direction and the second direction. The rod member of one of the first elongate members extends through an aperture of one of the second elongate members and an aperture of one of the third elongate members and is movably coupled thereto by its riveted portion.

20 Claims, 9 Drawing Sheets

(56) References Cited

U.S. PATENT DOCUMENTS 3,044,755 A 7/1962 Bixby et al.
3,092,375 A * 6/1963 Bixby ..... C21D 9/0025 220/491
3,698,698 A * 10/1972 Kreider ..... C21D 9/0025 432/253
3,739,921 A 6/1973 Schmidt
4,158,876 A * 6/1979 Pedro ..... H05K 13/0069 206/706
4,196,484 A * 4/1980 Harris ..... A47C 19/025 5/201
4,250,664 A 2/1981 Remke
4,295,234 A * 10/1981 Whitehead ..... A47C 19/04 403/107
4,407,411 A * 10/1983 Lowry ..... G11B 23/0236 206/387.14
4,427,379 A 1/1984 Duran et al.
4,429,937 A * 2/1984 Stockmaster ..... H05K 7/1425 361/796
4,958,891 A * 9/1990 Taylor ..... A47B 88/43 211/175
5,268,637 A * 12/1993 Liken ..... G01R 31/2817 324/537
5,500,963 A * 3/1996 Yeh ..... A47C 19/005 403/231
5,706,735 A * 1/1998 Lund ..... B61B 13/00 104/130.07
6,314,595 B1 * 11/2001 Price ..... A47C 19/005 5/11
6,346,003 B1 * 2/2002 Vilgiate ..... H05K 9/0016 361/799
6,386,491 B1 * 5/2002 Bissett ..... A47F 5/04 211/205
7,111,341 B2 * 9/2006 Hennings ..... A47C 19/00 5/2.1
7,209,359 B2 * 4/2007 Matthews ..... H05K 13/0069 361/752
7,384,264 B2 6/2008 Ego et al.
7,448,820 B1 * 11/2008 Faber ..... F16B 7/0453 256/65.08
7,568,247 B2 * 8/2009 Strobel ..... A61G 7/05 5/613
7,740,474 B2 6/2010 Scheibel et al.
8,327,480 B2 * 12/2012 Ganance ..... A61G 7/05 5/602
8,402,577 B2 * 3/2013 Harrow ..... A47C 19/005 5/201
9,047,039 B2 * 6/2015 Perkins ..... H04N 9/3147
2006/0054576 A1 * 3/2006 Durham ..... A47L 23/205 211/85.7

* cited by examiner

ARTICLE PROCESSING FIXTURE

CROSS-REFERENCE TO RELATED APPLICATIONS

This application claims the benefit of U.S. Provisional Application No. 61/892,871, filed Oct. 18, 2013, which is incorporated in its entirety herein by reference.

TECHNICAL FIELD

This application relates generally to a fixture and, more specifically, to a fixture for supporting articles in an industrial process.

BACKGROUND

In industrial processes such as, for example, heat treating processes (e.g., hardening, annealing, stress relieving, normalizing, solution annealing, aging, quenching, tempering, cryogenic treating, sintering, etc.), surface treating processes (e.g., coating, plating, carburizing, decarburizing, case hardening, nitriding, oxidizing, diffusion hardening, etc.), and joining processes (e.g., brazing, diffusion bonding, and soldering, etc.), articles can be placed on or within fixtures in controlled temperature and chemical environmental enclosures such as, for example, furnaces, ovens, cryogenic baths, molten metal baths, fluidized bed reactors, quench baths, molten salt baths, pickling tanks, passivation tanks, and others. Fixtures that are resistant to elevated temperatures, and highly corrosive atmospheres and environments, and have high mechanical strength, high thermal fatigue strength, and other durability factors can be used to contain, support, and transport the articles throughout the various process(es).

SUMMARY

The following presents a simplified summary of the disclosure in order to provide a basic understanding of some example aspects described in the detailed description.

In one embodiment, a fixture for supporting articles in an industrial process comprises a plurality of first elongate members extending longitudinally in a first direction. The plurality of first elongate members each comprise a rod member having a riveted portion at an end thereof. The fixture further comprises a plurality of second elongate members extending longitudinally in a second direction that is substantially perpendicular to the first direction and a plurality of third elongate members extending longitudinally in a third direction that is substantially perpendicular to the first direction and the second direction. The rod member of one of the first elongate members extends through an aperture of one of the second elongate members and an aperture of one of the third elongate members and is movably coupled thereto by its riveted portion.

In one example of the embodiment, the plurality of elongate members are movably coupled together to form a support platform for supporting articles that extends along a support plane.

In another example of the embodiment, each of the plurality of second and third elongate members comprises a flat stock member having a first connecting portion with a first aperture extending therethrough, a second connecting portion with a second aperture extending therethrough, and an intermediate portion joining the first connecting portion and the second connecting portion.

In yet another example of the embodiment, the flat stock member is non-bent and comprises a substantially flat first major surface, a substantially flat second major surface, and a thickness between the first and second major surfaces. In one example, the substantially flat first major surface extends perpendicular to the support plane.

In still yet another example of the embodiment, the first connecting portion comprises a first width, the second connecting portion comprises a second width, and the intermediate portion comprises an intermediate width that is less than both the first width and the second width. In one example, flat stock members for all of the second elongate members are identical to each other and flat stock members for all of the third elongate members are identical to each other.

In another example of the embodiment, the first portion comprises an edge portion that partially circumscribes an axis of the first aperture and maintains a substantially constant thickness of material partially about the aperture in a radial direction.

In yet another example of the embodiment, flat stock members for all of the second elongate members are substantially identical to each other and flat stock members for all of the third elongate members are substantially identical to each other.

In still yet another example of the embodiment, one of the first elongate members comprises a spacer that the rod member of the first elongate member is inserted through. The spacer defines a minimum or maximum distance between one of the plurality of second and third elongate members and another one of the plurality of second and third elongate members.

In another example of the embodiment, all of the plurality of elongate members are movably coupled to each other without welding that forms a load-bearing joint between the plurality of elongate members.

In yet another example of the embodiment, one of the plurality of elongate members comprises a first material and another one of the plurality of elongate members that is coupled thereto comprises a second material that is different from the first material. In one example, the first material comprises carbon and the second material comprises nickel alloy.

In still yet another example of the embodiment, the fixture further comprises at least one handle member movably coupled to the plurality of elongated members. In one example, the handle member comprises a first material and one of the plurality of elongate members that is coupled thereto comprises a second material that is different from the first material. In another example, the first material is lower in thermal strength than the second material. In still another example, the first material comprises carbon and the second material comprises nickel alloy.

In another example of the embodiment, the fixture further comprises a first stacking member comprising a first stacking portion and a second stacking member comprising a second stacking portion. In one example, the first and second stacking members are arranged such that when the fixture is stacked with an identical fixture with their first and second stacking portions aligned, the first stacking portion of the fixture will mate with the second stacking portion of the identical fixture. In another example, the first stacking portion of the fixture comprises a recess and the second stacking portion of the fixture comprises a projection that is receivable within the recess.

The embodiment described above may be provided alone or in combination with any one or more of the examples of the embodiment discussed above.

BRIEF DESCRIPTION OF THE DRAWINGS

Embodiments of the invention are better understood when the following detailed description is read with reference to the accompanying drawings, in which.

DETAILED DESCRIPTION

Figure 1:
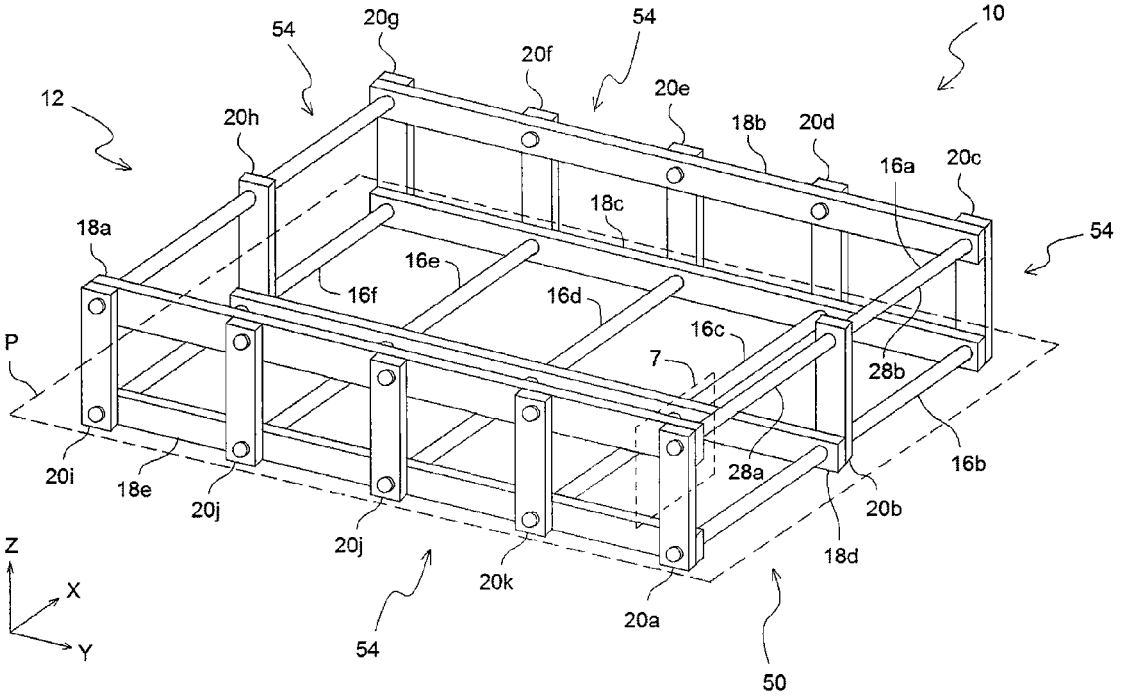
FIG. 1 is a perspective view of an example fixture.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is to be noted that the phrases "at least one of" and "one or more of", as used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

It is further to be noted that the phrases "substantially parallel" and "substantially perpendicular" as used herein respectively mean within 15 degrees or less of parallel and perpendicular, and more preferably, within 10 degrees or less of parallel and perpendicular.

It is still further to be noted that the phrase "substantially identical" as used herein when describing two or more features means that the features are manufactured to be identical but may have slight differences in composition, size, or shape due to manufacturing tolerances.

Examples will now be described more fully hereinafter with reference to the accompanying drawings in which example embodiments are shown. Whenever possible, the same reference numerals are used throughout the drawings to refer to the same or like parts. Also, references numerals in the 100's refer to structure that corresponds to structure referred to by reference numerals having the same last two numbers. For example, reference numeral "125" refers to structure that corresponds to the structure referred to by reference numeral "25". However, aspects may be embodied in many different forms and should not be construed as limited to the embodiments set forth herein.

A fixture 10 for supporting, containing, and transferring articles in an industrial process is shown in FIG. 1. More specifically, the fixture 10 may be used for supporting, containing, and transferring articles in industrial processes such as, for example, heat treating processes (e.g., hardening, annealing, stress relieving, normalizing, solution annealing, aging, quenching, tempering, cryogenic treating, sintering, etc.), surface treating processes (e.g., coating, plating, carburizing, decarburizing, case hardening, nitriding, oxidizing, diffusion hardening, etc.), and joining processes (e.g., brazing, diffusion bonding, and soldering, etc.). Articles can be placed on or within the fixture 10 in controlled temperature and chemical environmental enclosures such as, for example, furnaces, ovens, cryogenic baths, molten metal baths, fluidized bed reactors, quench baths, molten salt baths, pickling tanks, passivation tanks, and others.

The fixture 10 can comprise a plurality of elongate members 12 comprising a plurality of first elongate members 16 (16*a*-16*f*), a plurality of second elongate members 18 (18*a*-18*e*), and a plurality of third elongate members 20 (20*a*-20*k*). The plurality of first elongate members 16 each extend longitudinally in a first direction X, the plurality of second elongate members 18 each extend longitudinally in a second direction Y that is substantially perpendicular to the first direction X, and the plurality of third elongate members 20 each extend longitudinally in a third direction Z that is substantially perpendicular to the first direction X and the second direction Y. Notably, the fixture 10 may comprise other elongated members that do not extend longitudinally in any of directions X, Y and Z and rather may extend longitudinally in a direction transverse to directions X, Y and Z without departing from the scope of the invention.

Figure 2:
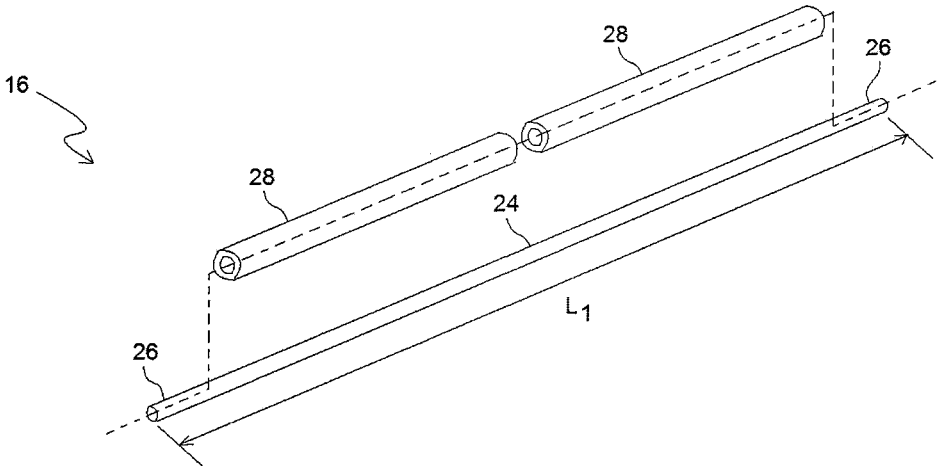
FIG. 2 is an exploded view of a first elongate member of the fixture.

The plurality of first elongate members 16 can each comprise a rod member 24 having a length $L_1$ and two end portions 26, as shown in FIG. 2. Furthermore, the plurality of first elongate members 16 can each comprise one or more spacers 28 that the rod member 24 is inserted through. For embodiments with multiple spacers 28, the spacers 28 can have similar lengths or different lengths with respect to each other. The rod member 24 and the spacers 28 may be substantially cylindrical though in some embodiments, the rod member 24 and the spacers may comprise other shapes.

The plurality of first elongate members 16 will preferably all have identical or substantially identical structure. By having identical or substantially identical structure, the manufacturing process for creating the plurality of first elongate members 16 is simplified because the same process can be used for all of the members, thus lowering manufacturing costs for the fixture 10. However, the plurality of first elongate members 16 may have structure that is different with respect to one another without departing from the scope of the invention. For example, the lengths of the rod member 24 and the one or more spacers 28 may vary for each first elongate member 16.

The plurality of second and third elongate members 18, 20 can each comprise a flat stock member 32, examples of which are shown in FIGS. 3-6. The flat stock member 32 comprises a length $L_2$, a first major surface 34, a second major surface 36, and a thickness $T_1$ between the first and second major surfaces 34, 36. The flat stock member 32 is made from flat stock and is preferably non-bent such that the first and second major surfaces 34, 36 are substantially flat and without bends. By not bending the flat stock member 32, manufacturing the flat stock member 32 is simplified and costs can be reduced. Moreover, improper bends in the flat stock member 32 can weaken the strength of the flat stock member 32. It is to be noted, however, that in some embodiments, the flat stock member 32 may be bent without departing from the scope of the invention.

The flat stock member 32 can comprise one or more connecting portions 40, each connecting portion having an aperture 42 extending through the flat stock member 32 from the first major surface 34 to the second major surface 36. The flat stock member 32 can further comprise one or more intermediate portions 44 joining the connecting portions 40. For example, the flat stock member 32 can comprise a first connecting portion 40*a* having a first aperture 42*a* extending therethrough along a first axis $X_1$, a second connecting portion 40*b* having a second aperture 42*b* extending therethrough along a second axis $X_2$, and an intermediate portion 44*a* joining the first and second connecting portions 40*a*, 40*b*. In some examples, the flat stock member 32 can comprise more than two connecting portions 40 and apertures 42 and more than one intermediate portion 44. The axes of the apertures 42 can be substantially parallel to each other and aligned to intersect substantially perpendicular with a longitudinal axis $Y_1$ of the flat stock member 32. However, in some examples, the axes can be transverse to each other and/or non-intersecting with the longitudinal axis $Y_1$.

Figure 3:
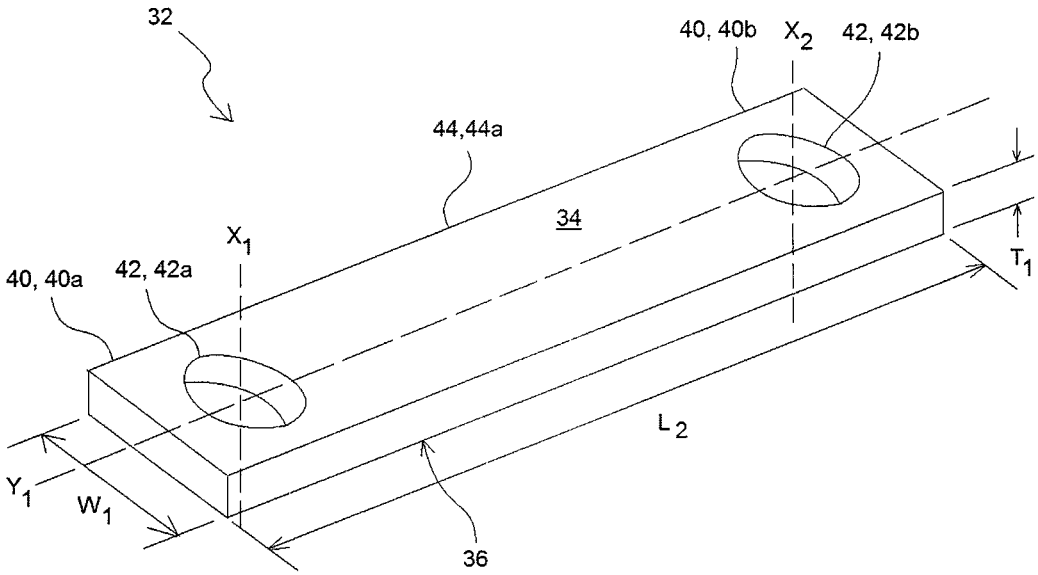
FIG. 3 is a perspective view of an example flat stock member of the fixture.
Figure 4:
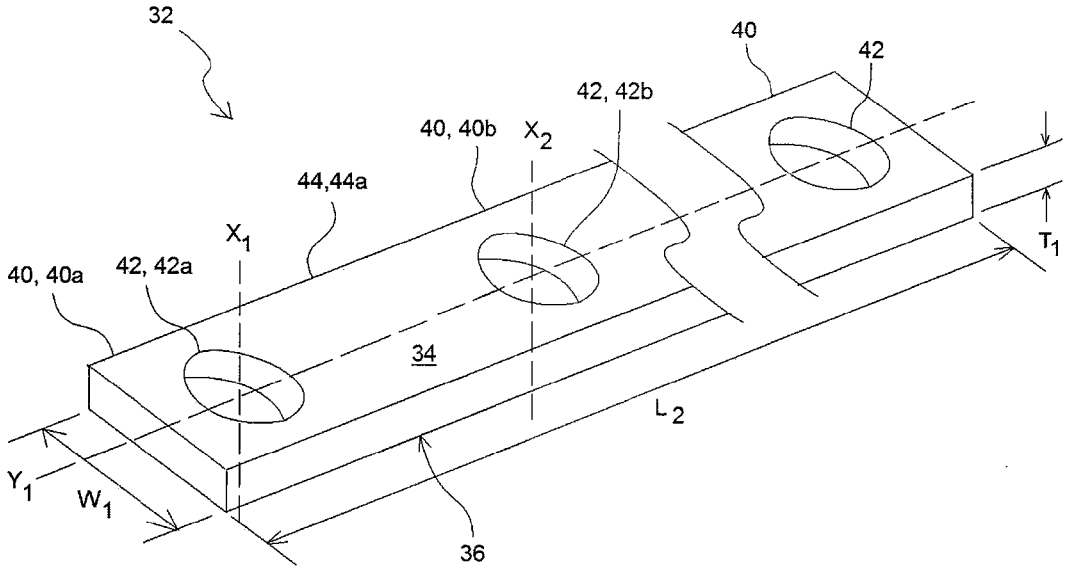
FIG. 4 is a perspective view of another example flat stock member of the fixture.

The flat stock member 32 can comprise a number of different shapes. For example, as shown in FIGS. 3 & 4, the first and second major surfaces 34, 36 of the flat stock member 32 can comprise a substantially rectangular shape having a width $W_1$ that is substantially constant along the length $L_2$ of the flat stock member 32. The width $W_1$ can be selected to ensure that the flat stock member 32 meets minimum desired strength properties.

Figure 5:
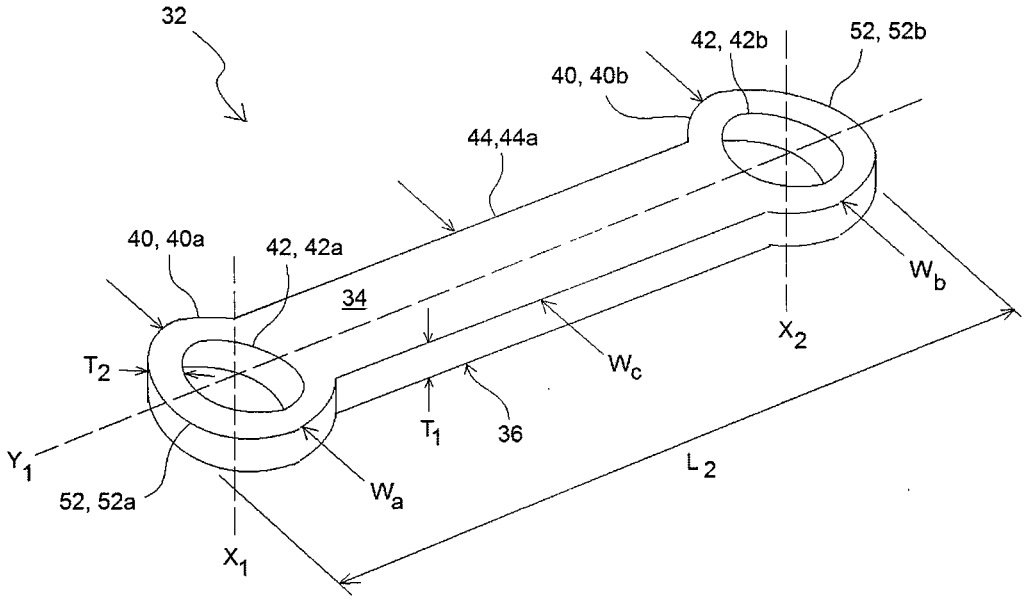
FIG. 5 is a perspective view of yet another example flat stock member of the fixture.
Figure 6:
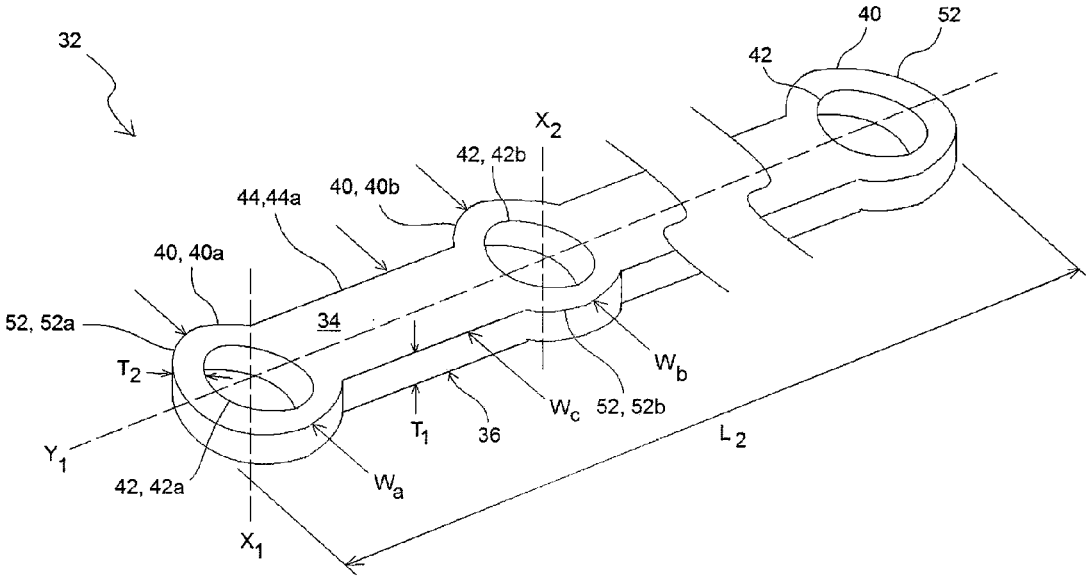
FIG. 6 is a perspective view of still yet another example flat stock member of the fixture.

Alternatively, as shown in FIGS. 5 & 6, the flat stock member 32 can comprise an alternative shape wherein the intermediate portion(s) 44 comprise a width that is less than the widths of each connecting portion 40. Moreover, the connecting portions 40 can each comprise an edge portion 52 that partially circumscribes the axis of its corresponding aperture 42 and maintains a substantially constant thickness $T_2$ of material partially about the aperture 42 in the radial direction. For example, the first connecting portion 40*a* can comprise a first edge portion 52*a* that partially circumscribes the axis $X_1$ of the first aperture 42*a* and the second connecting portion 40*b* can comprise a second edge portion 52*b* that partially circumscribes the axis $X_2$ of the second aperture 42*b*, maintaining a substantially constant thickness $T_2$ of material about the first and second apertures 42*a*, 42*b* in their radial directions. The thickness $T_2$ can be selected to meet minimum desired strength properties for the first and second connecting portions 40*a* of the flat stock member 32. As a result, the first and second connecting portions 40*a*, 40*b* will respectively comprise a first and second width $W_a$, $W_b$ that is defined by the selected thickness $T_2$ of material. Meanwhile, the intermediate portion 44*a* of the flat stock member 32 can comprise an intermediate width $W_c$ that is selected to meet minimum desired strength properties for the intermediate portion 44*a*. Because the intermediate portion 44*a* does not contain any apertures 42, the intermediate portion 44*a* can comprise an intermediate width $W_c$ that is less than both the first width $W_a$ and the second width $W_b$ while still maintaining a relatively high strength. The alternative shape thus permits the flat stock member 32 to be manufactured with less material than other shapes such as the rectangular shape described above wherein intermediate portions 44 have the same width as the connecting portions 40. Thus, material costs and overall weight of the fixture 10 can be reduced using the alternative shape.

The plurality of second and third elongate members 18, 20 can each comprise the flat stock member 32 according to any of the configurations discussed above. Moreover, plurality of second and third elongate members 18, 20 need not all comprise the flat stock member 32 according to the same configuration. For example, the shape, size, number of connecting portions 40, and number of intermediate portions 44 for the flat stock member 32 can vary for each of the second and third elongate members 18, 20. For instance, as can be seen in FIG. 1, the length of the plurality of second elongate members 18 can be greater than the length of the plurality of third elongate members 20. Moreover, the number of connecting portions 40 for the plurality of second elongate members 18 can be greater than the number of connecting portions 40 for the plurality of third elongate members 20. Preferably, however, the flat stock members 32 for all of the second elongate members 18 are identical or substantially identical to each other and the flat stock members 32 for all of the third elongate members 20 are identical or substantially identical to each other. Still more preferably, the flat stock members 32 for all of the second elongate members 18 and the third elongate members 20 are identical or substantially identical to each other. By having flat stock members 32 that are identical or substantially identical to each other, the manufacturing process for creating the plurality of second and third elongate members 18, 20 is simplified because the same process can be used for multiple elongate members, thus lowering manufacturing costs for the fixture 10.

The plurality of elongate members 12 are non-integral with each other and can be movably coupled together to form a support platform 50 for supporting articles that extends along a support plane P, as shown in FIG. 1. The plurality of elongate members 12 can also be movably coupled together to form wall portions 54 extending substantially perpendicular to the support plane P to contain the articles on the support platform 50. One or more of the second and third elongate members 18, 20 can be arranged such that their first and second major surfaces 34, 36 extend perpendicular to the support plane P. Such an arrangement will help improve the strength of the second and third elongate members 18, 20 in the Z direction and thus permit the fixture 10 to carry heavier articles. Preferably, all of the second and third elongate members 18, 20 are arranged such that their first and second major surfaces 34, 36 extend perpendicular to the support plane P.

Figure 7:
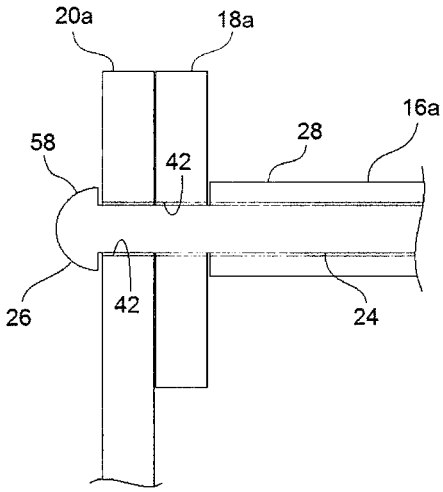
FIG. 7 is a cross-sectional view of the example fixture taken along plane 7 in FIG. 1.

The plurality of elongate members 12 can be movably coupled together by extending the rod member 24 of one of the first elongate members 16 through the apertures 42 of a second elongate member 18 and a third elongate member 20 and then forming a riveted portion at one or both end portions 26 of the rod member 24. For example, as can be seen in FIG. 7, the rod member 24 of first elongate member 16*a* extends through the aperture 42 of second elongate member 18*a* and the aperture 42 of third elongate member 20*a* and is coupled to the second and third elongate members 18*a*, 20*a* by a riveted portion 58 formed at its end portion 26. The riveted coupling is movable as it allows for differential movement between the elongate members 16*a*, 18*a*, 20*a*, thus permitting the elongate members 16*a*, 18*a*, 20*a* to expand, contract, warp, etc. during processing without damaging the coupling.

For embodiments wherein one or more of the first elongate members 16 comprises one or more spacers 28, the one or more spacers 28 can be used to help maintain the structure of the fixture 10 by defining a minimum and/or maximum distance between one of the plurality of second and third elongate members 18, 20 and another one of the plurality of second and third elongate members 18, 20. For example, as can be seen in FIG. 1, the first elongate member 16*a* comprises a first spacer 28*a* and a second spacer 28*b*. The first spacer 28*a* defines a minimum distance between the second elongate member 18*a* and third elongate member 20*b*. Meanwhile, the second spacer 28*b* defines a minimum distance between the third elongate member 20*b* and second elongate member 18*b*. The minimum distances defined by the spacers 28*a*, 28*b* may be identical or substantially identical to each other or different.

Figure 8:
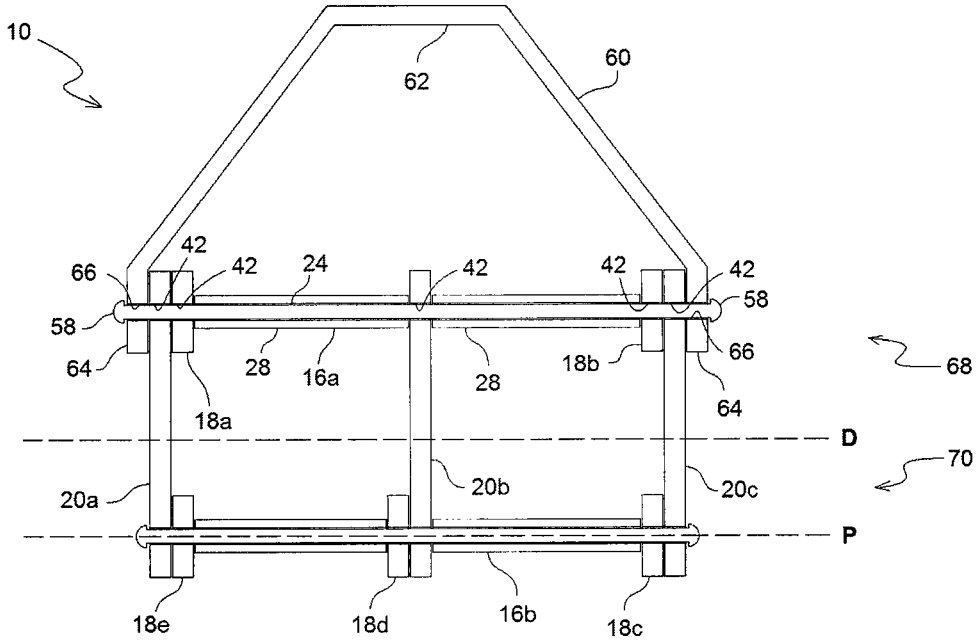
FIG. 8 is a cross-sectional view of another embodiment of the example fixture.

Turning now to FIG. 8, in some embodiments, the fixture 10 can further comprise a handle member 60. The handle member 60 may comprise one of the elongate members 12 discussed above or the handle member 60 may be a separate component of the fixture 10. In the present example, the handle member 60 is separate from the elongate members 12 discussed above and comprises a handle portion 62 and two connecting portions 64. In other examples, the handle member 60 may comprise just one connecting portion 64 or, alternatively, more than two connecting portions 64. Each connecting portion 64 can comprise an aperture 66 extending through the connecting portion 64. The handle portion 62 is preferably located above the plurality of elongated members 12 relative to the support plane P such that the handle portion 62 will experience relatively less severe thermal conditions than the lower positioned elongate members 12 during heat treatment processes.

The handle member 60 can be movably coupled to the plurality of elongated members 12 by extending the rod member 24 of one of the first elongate members 16 through an aperture 66 of the handle member 60 and an aperture 42 of one of the second elongate members 18 and/or an aperture 42 of one of the third elongate members 20. A riveted portion at the end portion 26 of the rod member 24 may then be formed to provide a riveted coupling. For example, as can be seen in FIG. 8, the rod member 24 of first elongate member 16*a* extends through both apertures 66 of the handle member 60 as well as apertures 42 in the second elongate members 18*a*, 18*b* and the third elongate members 20*a*, 20*b*, 20*c*. Riveted portions 58 are provided at both end portions 26 of the rod member 24, thereby movably coupling the handle member 60 to the first elongate member 16*a*, the second elongate members 18*a*, 18*b*, and the third elongate members 20*a*, 20*b*, 20*c*.

In some embodiments, some of the members 12, 60 of the fixture 10 may be coupled together using a riveted coupling as described above while some of the members 12, 60 may be coupled together using other forms of coupling such as, for example, bolting or welding. In other embodiments, all of the members 12, 60 can be movably coupled together using riveted couplings such that all of the members 12, 60 are movably coupled to each other without any welding. Preferably, the fixture 10 will have no welding that forms a load-bearing joint between any of its members 12, 60. Coupling the members 12, 60 together with riveted couplings instead of welds can allow for members 12, 60 of different materials to be coupled together that otherwise could not be coupled together via welds due to the differing properties of their materials.

For example, in some embodiments, one of the plurality of elongate members 12 can comprise a first material and another one of the plurality of elongate members 12 that is coupled thereto can comprise a second material that is different from the first material. For instance, as shown in FIG. 1, the first elongate member 16*a* can comprise a first material and is coupled to the second elongate member 18*a* and the third elongate member 20*a*, either or both of which can comprise a second material that is different from the first material. More specifically, the first material may comprise carbon steel while the second material comprises nickel alloy, though other materials such as for example, stainless steel, ceramic or some other dissimilar material to the first material may be used in different embodiments.

As another example, in some embodiments, the handle member 60 can comprise a first material and one of the plurality of elongate members 12 that is coupled thereto can comprise a second material that is different from the first material. For instance, as shown in FIG. 8, the handle member 60 can comprise a first material and is coupled to the first elongate member 16*a*, the second elongate members 18*a*, 18*b*, and the third elongate members 20*a*, 20*b*, 20*c*, any or all of which can comprise a second material that is different from the first material. More specifically, the second material for the elongate members 16*a*, 18*a*, 18*b*, 20*a*, 20*b*, 20*c* can comprise a high thermal strength material such as, for example, nickel alloy, that can withstand high thermal loads and/or highly corrosive applications/environments. Meanwhile, because the handle member 60 will experience relatively less severe conditions than the alternately positioned elongate members 16*a*, 18*a*, 18*b*, 20*a*, 20*b*, 20*c*, the first material for the handle member 60 may comprise a material that is lower in thermal strength but less expensive than the first material (e.g., lower alloy metal or carbon steel).

As yet another example, in some embodiments, the fixture 10 can comprise a plane of demarcation D that divides the fixture 10 into a top portion 68 and a bottom portion 70, the top portion 68 being above the bottom portion 70 relative to the support plane P. In such embodiments, the members 12, 60 located in the bottom portion 62 can comprise a first material while members 12, 60 located in the top portion 60 can comprise a second material. More specifically, the second material for the members 12, 60 located in the bottom portion 62 can comprise a high thermal strength material such as, for example, nickel alloy, that can withstand high thermal loads or highly corrosive applications. Meanwhile, because the members 12, 60 located in the top portion 60 will experience relatively less severe conditions than the alternately positioned members 12, 60 located in the bottom portion 62, the first material for the members 12, 60 located in the top portion 60 may comprise a material that is lower in thermal strength but less costly than the first material (e.g., lower alloy metal or carbon steel).

Although the above examples describe embodiments wherein some of the members 12, 60 comprise different materials, it is to be noted that in some embodiments, the members 12, 60 may all comprise the same material without departing from the scope of the invention. Moreover, although the above examples describe embodiments wherein one of the members 12, 60 comprises a first material while another one of the members 12, 60 comprises a second material, there may be embodiments wherein other members 12, 60 comprise one or more materials dissimilar to the first and second material without departing from the scope of the invention. Indeed, there may be embodiments wherein every one of the members 12, 60 comprises a material different from the rest of the members 12, 60.

Figure 9:
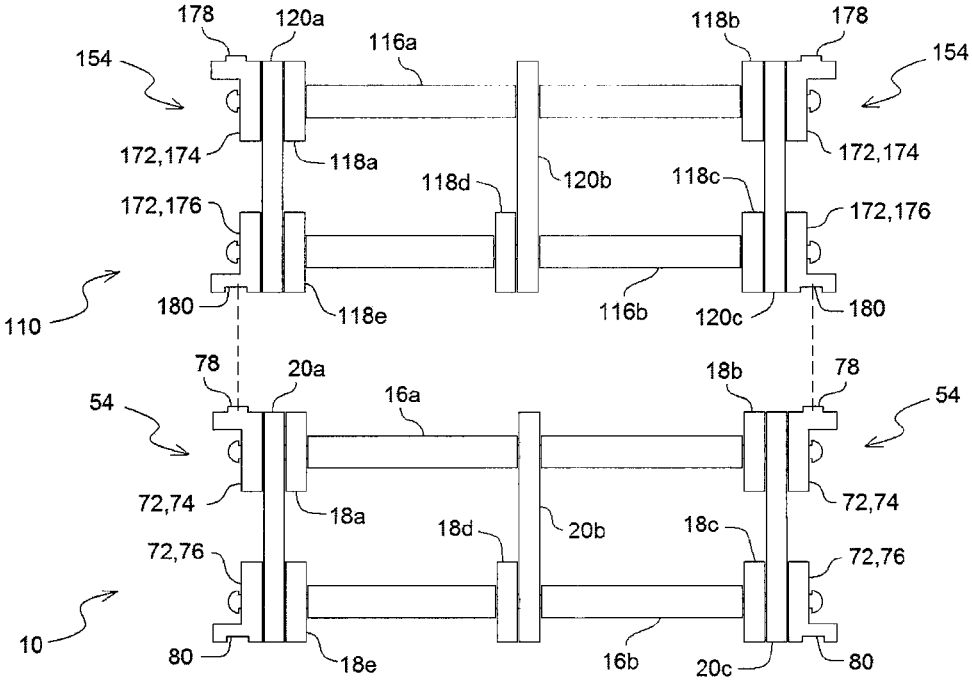
FIG. 9 is a side view of yet another embodiment of the example fixture and an identical fixture.

Turning now to FIG. 9, in some embodiments, the fixture 10 can further comprise a plurality of stacking members 72. Each stacking member 72 may be integral with one of the elongated members 12 described above or each stacking member 72 may be a separate component of the fixture 10. In some embodiments, some of the stacking members 72 may be integral with the elongated members 12 while some of the stacking members 72 may be separate components. In the present example, all of the stacking members 72 are separate components that are coupled to the elongate members 12.

The plurality of stacking members 72 can comprise one or more first stacking members 74 and one or more second stacking members 76. Each of the first stacking members 74 comprises a first stacking portion 78 while each of the second stacking members comprises a second stacking portion 80. The first and second stacking portions 78, 80 can comprise any structure that can mate and/or interlock with each other. For example, the first stacking portion(s) 78 of the fixture 10 can comprise a recess while the second stacking portion(s) 80 of the fixture 10 can comprise a projection that is receivable within the recess and can interlock with the first stacking portion(s) 78. As another example, the second stacking portion(s) 80 of the fixture 10 can comprise a recess and the first stacking portion(s) 78 of the fixture 10 can comprise a projection that is receivable within the recess and can interlock with the second stacking portion(s) 80.

The first and second stacking members 74, 76 of the fixture 10 can be arranged to mate with stacking members of another fixture. For example, as shown in FIG. 9, the first and second stacking members 74, 76 of the fixture 10 can be arranged such that when a fixture 110 having identical or substantially identical structure is stacked on top of the fixture 10 with the wall portions 54, 154 and stacking portions 78, 180 of both fixtures 10, 110 being aligned, the first stacking portion(s) 78 of the fixture 10 will mate with the second stacking portion(s) 180 of the second fixture 110. Likewise, the first and second stacking members 74, 76 of the fixture 10 can arranged such that when the fixture 10 is stacked on top of the fixture 110 with the wall portions 54, 154 and stacking portions 178, 80 of both fixtures 10, 110 being aligned, the first stacking portion(s) 178 of the identical fixture 110 will mate with the second stacking portion (s) 80 of the fixture 10. Thus, the first and second stacking members 72, 74 can assist in aligning the fixtures 10, 110 when stacking them together by guiding the fixtures 10, 110 into alignment with their structure.

It is to be noted that the fixture 10 may or may not comprise the plurality of stacking members 72 without departing from the scope of the invention. It is further to be noted that although the fixture 10 may comprise first and second stacking members 74, 76 arranged to mate with the first and second stacking members 174, 176 of the identical fixture 110, it is not intended that the identical fixture 110 be present for the fixture 10 to be within the scope of the invention. For example, in some embodiments, the fixture 10 may be stacked with a non-identical fixture. As another example, in some embodiments, a second fixture may not even be present. For instance, the fixture 10 may be by itself but comprise first and second stacking members 74, 76 arranged such that when the fixture 10 is stacked with an identical fixture with their wall portions aligned, the first stacking portion(s) 78 of the fixture 10 will mate with the second stacking portion(s) of the identical fixture.

Illustrative embodiments have been described, hereinabove. It will be apparent to those skilled in the art that various modifications and variations can be made without departing from the spirit and scope of the claimed invention. It is intended to include all such modifications and alterations within the scope of the present invention.

What is claimed is:

1. A fixture for supporting articles in an industrial process comprising a plurality of elongate members comprising:

a plurality of first elongate members extending longitudinally in a first direction, wherein the plurality of first elongate members each comprises a rod member having a riveted portion at an end thereof;

a plurality of second elongate members extending longitudinally in a second direction that is substantially perpendicular to the first direction; and a plurality of third elongate members extending longitudinally in a third direction that is substantially perpendicular to the first direction and the second direction, wherein the rod member of one of the plurality of first elongate members extends through an aperture of one of the plurality of second elongate members and an aperture of one of the plurality of third elongate members and is movably coupled thereto by the riveted portion of the rod member, wherein the plurality of first, second and third elongate members are movably coupled together to form a support platform for supporting articles that extends along a support plane, wherein each of the plurality of second and third elongate members comprises a flat stock member having a first connecting portion with a first aperture extending therethrough, a second connecting portion with a second aperture extending therethrough, and an intermediate portion joining the first connecting portion and the second connecting portion, and wherein the first connecting portion comprises a first width, the second connecting portion comprises a second width, and the intermediate portion comprises an intermediate width that is less than both the first width and the second width.

2. The fixture according to claim 1, wherein the plurality of elongate members are movably coupled together to form wall portions extending substantially perpendicular to the support plane to contain the articles on the support platform.

3. The fixture according to claim 2, further comprising a first stacking member comprising a first stacking portion and a second stacking member comprising a second stacking portion.

4. The fixture according to claim 3, wherein the first and second stacking members are arranged such that when the fixture is stacked with a substantially identical fixture with the first and second stacking portions of the fixture and identical fixture aligned, the first stacking portion of the fixture will mate with the second stacking portion of the identical fixture.

5. The fixture according to claim 3, wherein the first stacking portion of the fixture comprises a recess and the second stacking portion of the fixture comprises a projection that is receivable within the recess.

6. The fixture according to claim 1, wherein the flat stock member is non-bent and comprises a substantially flat first major surface, a substantially flat second major surface, and a thickness between the substantially flat first and second major surfaces.

7. The fixture according to claim 6, wherein the substantially flat first major surface extends perpendicular to the support plane.

8. The fixture according to claim 1, wherein flat stock members for all of the plurality of second elongate members are substantially identical to each other and flat stock members for all of the plurality of third elongate members are substantially identical to each other.

9. The fixture according to claim 1, wherein one of the plurality of first elongate members comprises a spacer that the rod member of the first elongate member is inserted through, further wherein the spacer defines a minimum or maximum distance between one of the plurality of second and third elongate members and another one of the plurality of second and third elongate members.

10. The fixture according to claim 1, wherein all of the plurality of elongate members are movably coupled to each other without welding that forms a load-bearing joint between the plurality of elongate members.

11. The fixture according to claim 1, wherein one of the plurality of elongate members comprises a first material and is coupled to another one of the plurality of elongate members comprising a second material that is different from the first material.

12. The fixture according to claim 11, wherein the first material comprises carbon and the second material comprises nickel alloy.

13. The fixture according to claim 1, further comprising at least one handle member movably coupled to the plurality of elongated members, wherein the handle member comprises a first material and one of the plurality of elongate members that is coupled thereto comprises a second material that is different from the first material.

14. The fixture according to claim 13, wherein the first material is lower in thermal strength than the second material.

15. The fixture according to claim 14, wherein the first material comprises carbon and the second material comprises nickel alloy.

16. The fixture according to claim 1, wherein the riveted portion for each of the plurality of first elongate members is an integral component of an associated rod member.

17. A fixture for supporting articles in an industrial process comprising a plurality of elongate members comprising:

a plurality of first elongate members extending longitudinally in a first direction, wherein the plurality of first elongate members each comprises a rod member having a riveted portion at an end thereof;

a plurality of second elongate members extending longitudinally in a second direction that is substantially perpendicular to the first direction; and a plurality of third elongate members extending longitudinally in a third direction that is substantially perpendicular to the first direction and the second direction, wherein the rod member of one of the plurality of first elongate members extends through an aperture of one of thei plurality of second elongate members and an aperture of one of the plurality of third elongate members and is movably coupled thereto by the riveted portion of the rod member, wherein the plurality of first, second and third elongate members are movably coupled together to form a support platform for supporting articles that extends along a support plane, wherein each of the plurality of second and third elongate members comprises a flat stock member having a first connecting portion with a first aperture extending therethrough, a second connecting portion with a second aperture extending therethrough, and an intermediate portion joining the first connecting portion and the second connecting portion, and wherein the first connecting portion comprises an edge portion that partially circumscribes an axis of the first aperture and maintains a substantially constant thickness of material partially about the aperture in a radial direction.

18. The fixture according to claim 17, wherein one of the plurality of first elongate members comprises a spacer that the rod member of the first elongate member is inserted through, further wherein the spacer defines a minimum or maximum distance between one of the plurality of second and third elongate members and another one of the plurality of second and third elongate members.

19. The fixture according to claim 17, wherein one of the plurality of elongate members comprises a first material and is coupled to another one of the plurality of elongate members comprising a second material that is different from the first material.

20. The fixture according to claim 17, further comprising a first stacking member comprising a first stacking portion and a second stacking member comprising a second stacking portion, wherein the first and second stacking members are arranged such that when the fixture is stacked with a substantially identical fixture with the first and second stacking portions of the fixture and identical fixture aligned, the first stacking portion of the fixture will mate with the second stacking portion of the identical fixture.

* * * * *